US006920731B2

(12) United States Patent
Skettle et al.

(10) Patent No.: US 6,920,731 B2
(45) Date of Patent: Jul. 26, 2005

(54) INSULATED STRUCTURE

(75) Inventors: Michael A. Skettle, North Olmsted, OH (US); Joseph Zupancic, III, Barberton, OH (US); Robert A. Konnerth, Streetsboro, OH (US); Hugh H. Storms, North Canton, OH (US)

(73) Assignee: ETS Schaefer Corporation, Macedonia, OH (US)

( * ) Notice: Subject to any disclaimer, the term of this patent is extended or adjusted under 35 U.S.C. 154(b) by 37 days.

(21) Appl. No.: 10/193,840

(22) Filed: Jul. 12, 2002

(65) Prior Publication Data

US 2004/0006933 A1 Jan. 15, 2004

(51) Int. Cl.[7] ..... E04B 2/00
(52) U.S. Cl. ..... 52/586.01; 52/309.8
(58) Field of Search ..... 52/506.01, 309.8, 52/506.04, 506.06, 404.1, 223.7

(56) References Cited

U.S. PATENT DOCUMENTS

| | | | | |
|---|---|---|---|---|
| 3,832,815 A | * | 9/1974 | Balaz et al. | 52/223.7 |
| 3,854,262 A | | 12/1974 | Brady | |
| 4,287,839 A | | 9/1981 | Severin et al. | |
| 4,318,259 A | * | 3/1982 | Verheyden | 52/404.1 |
| 4,339,902 A | * | 7/1982 | Cimochowski et al. | 52/506.02 |
| 4,391,075 A | * | 7/1983 | Musgrave | 52/404.1 |
| 4,411,621 A | | 10/1983 | Miller | |
| 4,429,504 A | | 2/1984 | Hounsel et al. | |
| 4,449,345 A | | 5/1984 | Hounsel et al. | |
| 4,494,295 A | | 1/1985 | Herring | |
| 4,523,531 A | | 6/1985 | Bishara | |
| 4,549,382 A | | 10/1985 | Byrd, Jr. | |
| 4,605,583 A | | 8/1986 | Frahme | |
| 4,733,620 A | | 3/1988 | Robbins | |
| 4,829,734 A | | 5/1989 | Schraff | |
| 5,209,038 A | | 5/1993 | Robbins | |
| 5,518,215 A | | 5/1996 | Lyons | |
| 6,095,807 A | | 8/2000 | Reyes-Gonzales | |

OTHER PUBLICATIONS

Installation Procedures—Stackbond Constructions, from Fiberwall™ Installation Manual by Carborundum 10 (date unknown).
Installation Hangers—Insulation Lacing Anchor data sheet by Stud Welding Associates (date unknown).
Insulation Hangers—Self Locking Washers data sheet by Stud Welding Associates (date unknown).
Insulation Anchors—Annular Ring Anchor Bolt by Midwest Fasteners, Inc. (date unknown).

* cited by examiner

*Primary Examiner*—Carl D. Friedman
*Assistant Examiner*—Steve Varner
(74) *Attorney, Agent, or Firm*—Thompson Hine LLP

(57) ABSTRACT

An insulated structure including a backing surface, a bar coupled to and extending generally parallel to the backing surface, and a plurality of insulating blankets coupled to the bar. The insulated structure further includes a clip coupled to the bar, the clip being attachable to the bar at any of a plurality of locations along the length of the bar to compress at least one of the blankets.

9 Claims, 4 Drawing Sheets

INSULATED STRUCTURE

The present invention is directed to an insulated structure, and more particularly, to an insulated structure including a plurality of insulating blankets.

BACKGROUND

Insulating structures, such as furnaces, ladles, preheaters, tundishes and associated parts and components and the like are desired to be highly insulated to maintain heat inside the associated structure. Many of these insulated structures or components include a plurality of insulating blankets stacked adjacent to each other to increase the insulation properties of the component. Accordingly, there is a need for an improved insulating structure, and method for assembling such structures.

SUMMARY

The present invention is an insulated structure which provides high insulating capabilities. The present invention also includes a relatively quick and easy method for assembling an insulated structure.

In one embodiment, the invention is an insulated structure including a backing surface, a bar coupled to and extending generally parallel to the backing surface, and a plurality of insulating blankets coupled to the bar. The insulated structure further includes a clip coupled to the bar, the clip being attachable to the bar at any of a plurality of locations along the length of the bar to compress at least one of the blankets. Other objects and advantages of the present invention will be apparent from the following description and the accompanying drawings.

DETAILED DESCRIPTION

Figure 1:
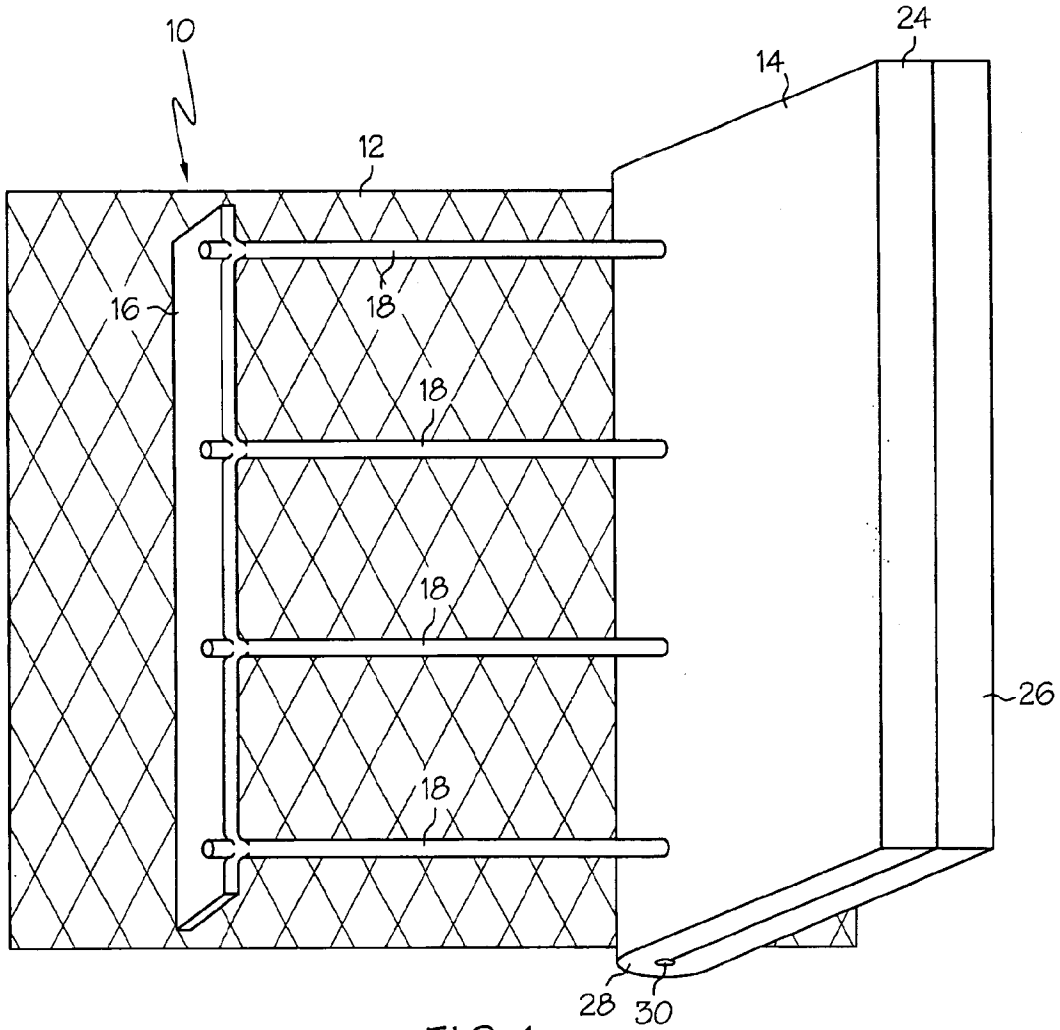
FIG. 1 is a top perspective view of one embodiment of a partially assembled insulated structure.
Figure 2:
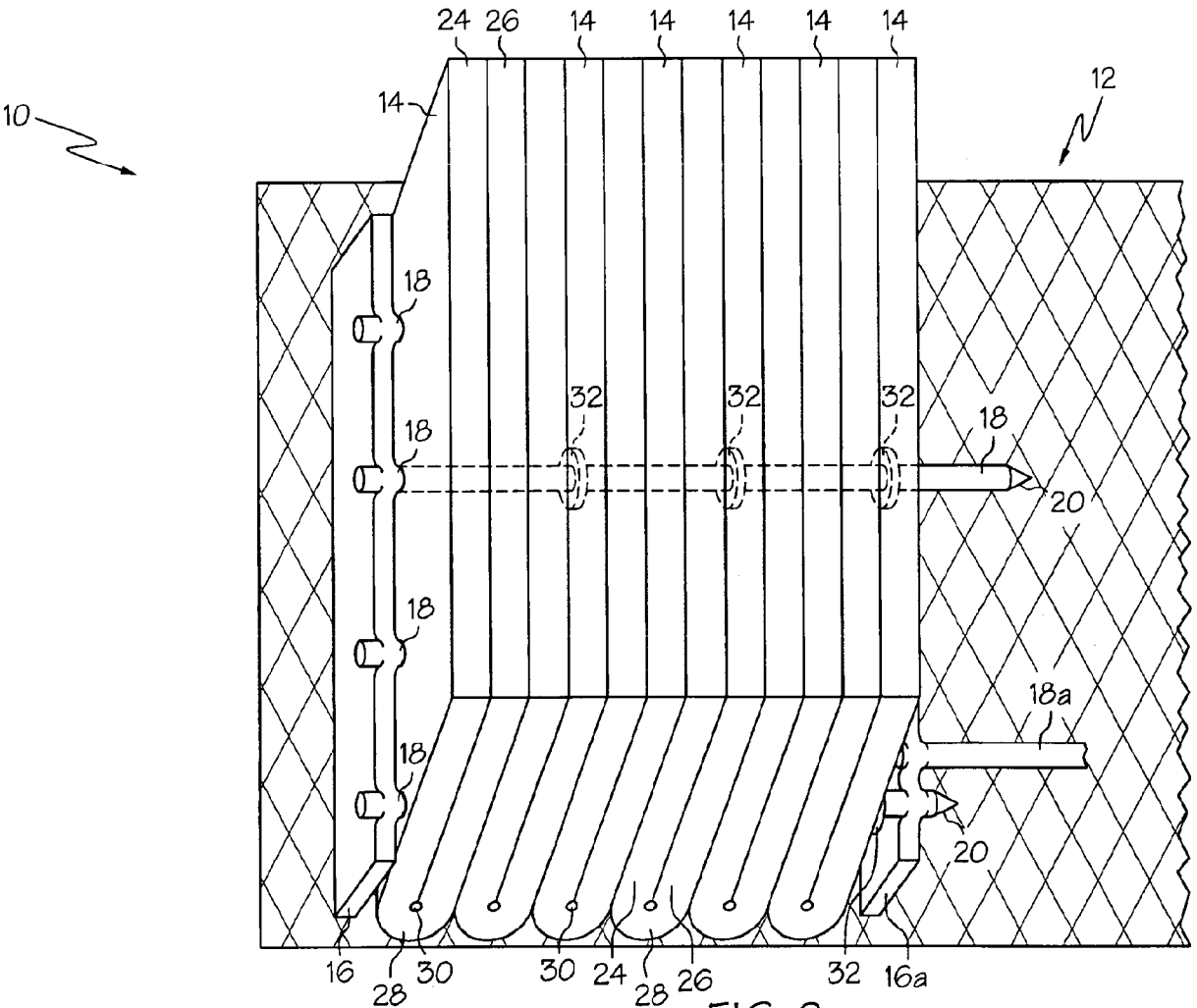
FIG. 2 is a top perspective view of an insulated structure, including one assembled section of insulating blankets.
Figure 3:
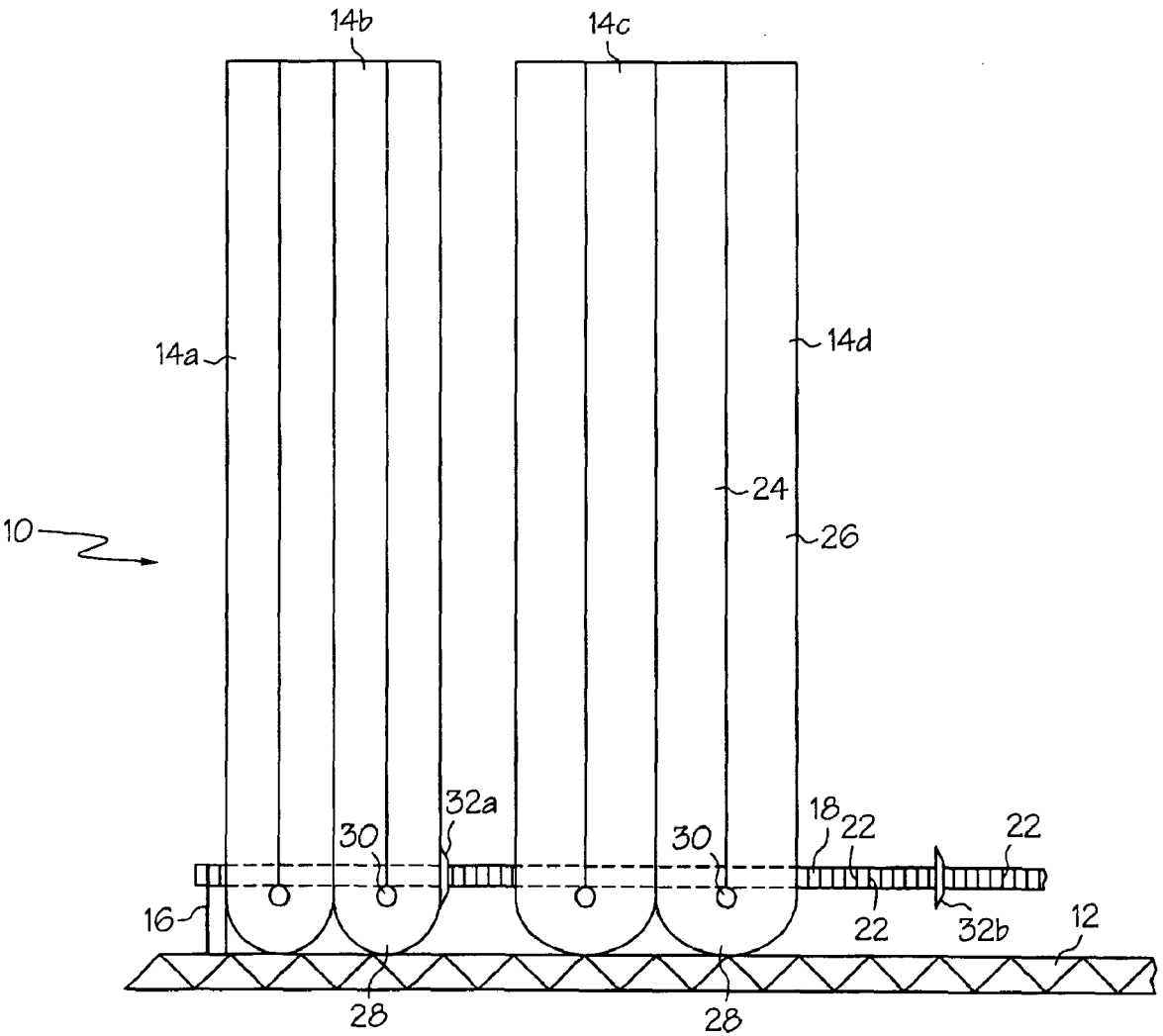
FIG. 3 is a side view of a partially assembled insulated structure.

As shown in FIGS. 1–3, one embodiment of the insulated structure of the present invention, generally designated 10, includes a backing surface 12 and a plurality of blankets 14 coupled to the backing surface 12. The backing surface 12 can be made from nearly any piece of preferably generally flat, planar, sheet-like material. For example, the backing surface 12 can be expanded metal, grating, mesh material, solid sheeting, metal plates, etc. The backing surface 12 may be coupled to any of a variety of structural frames or components (not shown), such as the frame or component of a furnace, ladle, preheater, tundish or the like.

The insulated structure 10 may include a connector 16 coupled to, and extending generally perpendicular to, the backing surface 12. The connector 16 can be nearly any desired shape or configuration but in the illustrated embodiments is a ¼"×1" flat bar coupled to the backing plate 12 by any desired manner, such as welding. The insulated structure 10 may include a plurality of generally parallel bars or pins 18 that are coupled to the connector 16 and extend generally parallel to the backing surface 12. In the illustrated embodiment, as best shown in FIG. 1, each bar 18 is coupled to the connector 16 (i.e., by welding) at one end of the bar 18 such that each bar 18 extends away from the connector 16 in a generally cantilevered manner. However, the bars 18 can be coupled to the backing surface 12/connector 16 in a wide variety of manners other than the manner illustrated herein.

Each of the bars 18 can have a circular, square or any other desired cross section. As illustrated in FIG. 2, each bar 18 may have a somewhat sharpened tip 20 for purposes which will be clear below. Each bar 18 may be smooth or may have a roughened or frictional outer surface, which can be formed by a plurality of raised ridges, grooves and the like. In a preferred embodiment, each of the bars 18 may include a series of raised circumferential ridges 22 (FIG. 3) in the manner of commercial rebar (that is, reinforcing bars for concrete structures). However, each bar 18 may have nearly any roughened, knurled or frictional outer surface formed in nearly any desired manner.

The insulating structure 10 may include a plurality of insulating blankets 14 coupled to the backing surface 12 and/or connector 16 or bars 18. In the illustrated embodiment, each blanket 14 is folded about itself in a generally "U" shape (see FIG. 4) such that each blanket 14 includes a pair of parallel legs 24, 26 and a connecting portion 28. Each blanket 14 is preferably made of a highly insulating refractory material such as ceramic fiber blanket, mineral wool fiber or other refractory ceramic fiber ("RCF") materials. However, the insulating blankets or material 14 can be made from a wide variety of other materials, including but not limited to non-RCF insulating materials such as biosoluble fibers, or Minsil blanket manufactured by Minteq International, Inc. of Slippery Rock, Pa. However, the insulating material 14 can be made of nearly any material that is sufficiently heat resistant. Furthermore, although the term "blankets" is used herein, it should be understood that nearly any insulating material, preferably in sheet form, may be used instead of the blankets without departing from the scope of the invention.

Each folded blanket 14 may include a rod 30 located in the fold of the blanket 14 and located underneath the bars 18. Thus, each rod 30 extends generally parallel to the backing surface 12 and generally perpendicular to the bars 18. In this manner, the bars 18 and rods 30 interact to maintain the insulating blanket 14 on or adjacent to the backing surface 12.

The insulated structure 10 may also include a plurality of clips 32, such as a speed clip, slip nut or lock nut with each clip 32 being slidably yet releasably located on one of the bars 18. Each clip 32 is preferably slidably located on the associated bar 18 such that the clip 32 moves in one direction along the bar 18 in a "ratcheting" manner. In other words, the clip 32 can preferably be moved along one direction of the bar 18 easier than the other direction. However, it is within the scope of the invention to provide a clip 32 which resists movement along the bar 18 equally in both directions. Thus, the term "releasably attachable" may include a clip/bar engagement wherein the clip 32 is coupled to the bar 18, but can be slid along the bar (in one or two directions) when a sufficient force is applied.

Figure 5:
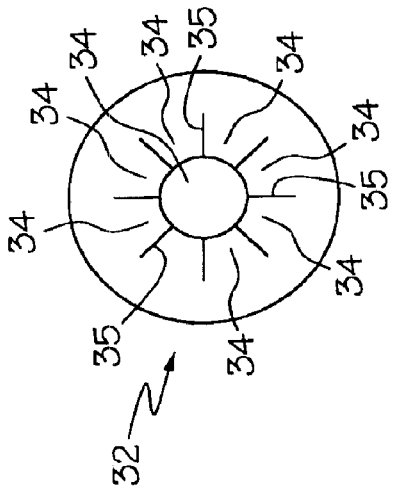
FIG. 5 is a front view of a clip that may be used in the system of the present invention.

In one embodiment, as shown in FIG. 5, each clip 32 includes a central opening 34 which is shaped to receive a bar 18 therein, and may be slightly smaller in diameter than the outer diameter of the bar 18. The clip 32 may include a plurality of deflectable flanges 34 which are defined by slits 35 formed in the clip 32. Each flange 34 is shaped and located to engage the outer surface or outer roughened surface of the bar 18. Similar clips are made by Stud Welding Associates of Elyria, Ohio and sold as "Self Locking Washers," "Insulation Speed Clips" or "Speed Clips."

For example, when the bar 18 is rebar and includes a plurality of circumferentially extending ridges 22, the flanges 34 of the clip can engage and "ride over" each ridge 22 as the clip 32 is slid along the bar 18. Each clip 32 is preferably sidable along substantially the entire length of each bar 18 such that each clip 32 can be coupled to the bar 18 at nearly any desired location along the length of the bar 18. Each clip 32 preferably engages the outer surface of one of the blankets 14 and holds one or more blankets 14 in compression along the direction of the bar 18, as shown in FIG. 2. Thus, the clips 32 can preferably be slid along the bars 18 when a predetermined sliding force is applied (i.e., by hand or machine) but the interaction between the clips 32 and bars 18 is preferably sufficient to resist expansion forces supplied by the blankets 14 onto the clips 32 once the blankets 14 have been compressed. For example, the clips 32 may move along the bars 18 when a force of between about 1 lb. to about 25 lb. is applied.

Although the insulated structure 10 may be assembled in a variety of manners, in one embodiment the insulated structure 10 is assembled by providing a backing surface 12, and then coupling a connector 16 to the backing surface 12 by any desired manner, such as welding. If desired, a plurality of connectors 16 may be coupled to the backing surface at this time. The plurality of bars 18 are then located on top of the connector 16 and coupled thereto (i.e., by welding). Although the bars 18 may be of nearly any desired shape or spacing, in one embodiment the bars are equally spaced apart from each other by a range of between about 8" to 24" on center.

Figure 4:
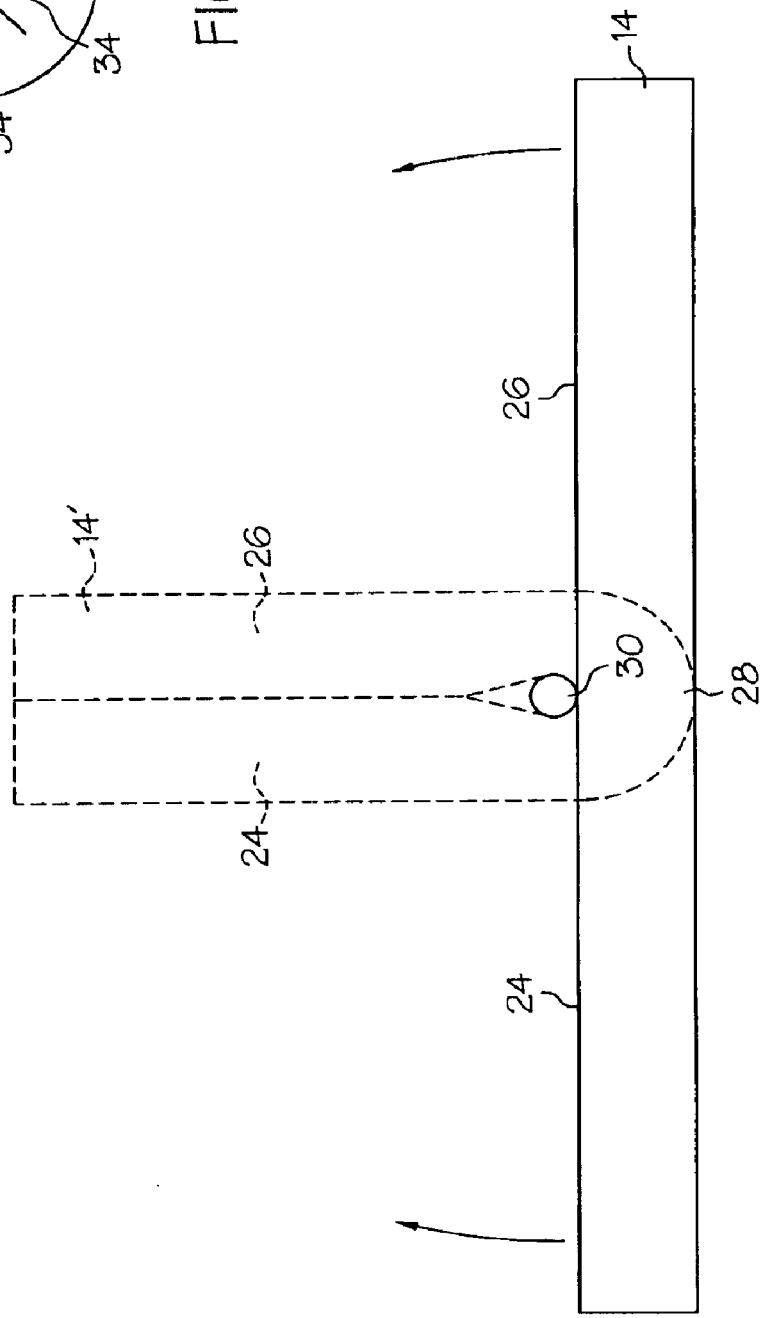
FIG. 4 is a side view of a blanket and associated rod.

Next, the blankets 14 are provided and folded about themselves, and a rod 30 is located in the crease of each fold (see FIG. 4, which illustrates an unfolded blanket 14 in solid lines and a folded blanket 14' in hidden lines). The first folded insulation blanket 14 is then impaled onto the tips 20 of the bars 18 such that the rod 30 is located between the bars 18 and backing surface 12 (see FIG. 1). The blanket 14 and rod 30 are then slid along the length of the backing surface 12 and bars 18 until the blanket 14 and rod 30 are located adjacent to the connector 16 (i.e., see blanket 14*a* of FIG. 3). An additional number of insulating blankets 14 are then folded, receive a rod 30 in their folds, and are impaled onto and slid along the bars 18 until the blankets 14 are located adjacent to another insulating blanket (i.e., see blanket 14*b* of FIG. 3).

Next, a clip 32 is located on each of the bars 18 and slid along the length of the bars 18 until the clip 32 engages the outer surface of the last-loaded insulating blanket (see clip 32*a* engaging blanket 14*b* in FIG. 3). The clip 32 is then pushed further along the direction of the bar 18 until the blankets 14 are sufficiently compressed between the clip 32 and connector 16. Additional blankets (i.e., see blankets 14*c*, 14*d* of FIG. 3) are then mounted onto the bars 18 in a similar manner, and another clip (i.e. see clip 32*b* of FIG. 3) is mounted onto the bars. Additional blankets 14 are then mounted onto the bars 18 until all the desired blankets 14 are located on the bars 18 and backing surface 12. Additional blankets may then be located on any other bars 18 which may be located on the backing surface 12 in order to form the desired structure. Although two blankets 14 are disclosed as being located between each clip 32, any desired number of blankets 14 (i.e., one or more) can be located between each clip 32.

If desired, another connector (see connector 16*a* of FIG. 2) may be located under or adjacent to the free ends of the bars 18, and the free ends of the bars 18 are then coupled to the additional connector 16*a* (i.e., by welding) to support the free ends of the bars 18 and to completely capture the blankets 14 onto the backing surface 12. If desired, a new set of bars (i.e., see bar 18*a* of FIG. 2) are then coupled to the additional connector 16*a*, and the mounting process is repeated as desired.

The insulated structure 10 disclosed herein can be or form part of nearly any desired insulating component, such as a furnace door, furnace roof or wall, molten metal ladle cover, ladle preheater, ladle dryer, tundish cover, tundish preheater, tundish dryer, soaking pit cover, heat shield, or any other application where heat is desired to be contained or objects or people are desired to be protected from high temperatures.

Having described the invention in detail and by reference to the preferred embodiments, it will be apparent that modifications and variations thereof are possible without departing from the scope of the invention.

What is claimed is:

1. An insulated structure comprising:

a backing surface;

a bar coupled to and extending generally parallel to said backing surface;

a plurality of insulating blankets coupled to said bar, each insulating blanket being folded about itself to form a crease;

a clip coupled to said bar, said clip being slidably yet releasably attachable to said bar at any of a plurality of locations substantially along the entire length of said bar; and a plurality of rods, each rod being located in the crease of one of said insulating blankets, wherein said clip is directly releasably attachable to said bar and is not directly coupled to any of said rods.

2. An insulated structure comprising:

a backing surface;

a bar coupled to and extending generally parallel to said backing surface;

a plurality of insulating blankets coupled to said bar, each blanket having a pair of generally parallel major outer surfaces, each major outer surface being spaced apart from any other major outer surface of that blanket and being located on an outer periphery of the blanket; and a clip coupled to said bar, said clip and said bar each being shaped or configured such that said clip and said bar can interact such that said clip is attachable to said bar at any of a plurality of locations along the length of said bar wherein said clip engages a major outer surface of a blanket and compresses said blanket along the direction of said bar.

3. An insulated structure comprising:

a backing surface;

a bar coupled to and extending generally parallel to said backing surface;

a plurality of insulating blankets coupled to said bar, each insulating blanket having a width, each blanket being folded about itself and having a pair of major outer surfaces and a pair of major inner surfaces, said major inner surfaces facing each other and being pressed together; and a plurality of clips slidably coupled to said bar, said clip being attachable to said bar at any of a plurality of locations along the length of said bar such that said clip can slide along said bar a distance at least equal to said width of said blanket to compress an adjacent blanket along a direction of said bar to press said major inner surfaces together, wherein at least one insulating blanket is located between at least two clips, and wherein each clip engages and presses against a major outer surface of an installed blanket.

4. A method for assembling an insulated structure comprising the steps of:

providing a backing surface having a bar coupled thereto;

providing a plurality of insulating blankets, each insulating blanket having a width;

coupling said insulating blankets to said bar such that each blanket has an outer surface in its coupled position;

sliding a clip along said bar until said clip engages an outer surface of a blanket and compresses one of said insulating blankets; and releasing said clip, wherein said clip and said bar cooperate to block said clip from significantly sliding along said bar.

5. The method of claim 4 wherein said sliding step includes sliding said clip until said clip engages said one of said insulating blankets.

6. The method of claim 4 further comprising the steps of, after said second providing step, folding each insulating blanket about itself and locating each insulating blanket such that the crease of each insulating blanket is located adjacent said backing surface.

7. The method of claim 6 further comprising the step of providing a plurality of rods and locating each rod in the fold of one of said insulating blankets.

8. The method of claim 6 wherein each rod extends generally parallel to said backing surface and generally perpendicular to each bar, and wherein each rod is located between said bar and said backing surface.

9. The method of claim 4 wherein coupling step includes impaling each blanket on said bar.

* * * * *